US006944589B2

(12) United States Patent
Yoshioka et al.

(10) Patent No.: US 6,944,589 B2
(45) Date of Patent: Sep. 13, 2005

(54) VOICE ANALYZING AND SYNTHESIZING APPARATUS AND METHOD, AND PROGRAM

(75) Inventors: Yasuo Yoshioka, Hamamatsu (JP); Jordi Bonada Sanjaume, Barcelona (ES)

(73) Assignee: Yamaha Corporation, Hamamatsu (JP)

( * ) Notice: Subject to any disclaimer, the term of this patent is extended or adjusted under 35 U.S.C. 154(b) by 704 days.

(21) Appl. No.: 10/093,969

(22) Filed: Mar. 8, 2002

(65) Prior Publication Data

US 2002/0184006 A1 Dec. 5, 2002

(30) Foreign Application Priority Data

Mar. 9, 2001 (JP) ..... 2001-067257

(51) Int. Cl.[7] ..... G10L 19/02
(52) U.S. Cl. ..... 704/209; 704/220
(58) Field of Search ..... 704/205, 207, 704/209, 219, 220, 221, 222, 223

(56) References Cited

U.S. PATENT DOCUMENTS 4,584,922 A 4/1986 Kamiya
4,827,516 A * 5/1989 Tsukahara et al. ..... 704/224
5,703,311 A 12/1997 Ohta

OTHER PUBLICATIONS

Cano, P. et al., "Voice morphing system for impersonating in karaoke applications," *Proceedings of the International Computer Music Conference 2000*, Berlin, Germany, pp. 1–4, retrieved from the internet at URL:www.iua.upf.es/xserra/articles on jul. 7, 2003.
Macon, M. W. et al., "A singing voice synthesis system based on sinusoidal modeling," *Acoustics, Speech and Signal Processing*, 1997.

* cited by examiner

*Primary Examiner*—Abul K. Azad
(74) *Attorney, Agent, or Firm*—Pillsbury Winthrop Shaw Pittman LLP

(57) ABSTRACT

A voice analyzing apparatus comprises: a first analyzer that analyzes a voice into harmonic components and inharmonic components: a second analyzer that analyzes a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and a memory that stores the inharmonic components, the magnitude spectrum envelope of the vocal cord vibration waveform, resonances and the spectrum envelope of the difference.

13 Claims, 11 Drawing Sheets

VOICE ANALYZING AND SYNTHESIZING APPARATUS AND METHOD, AND PROGRAM

CROSS REFERENCE TO RELATED APPLICATION

This application is based on Japanese Patent Application No. 2001-067257, filed on Mar. 9, 2001, the whole contents of which are incorporated herein by reference.

BACKGROUND OF THE INVENTION

A) Field of the Invention

The present invention relates to a voice synthesizing apparatus, and more particularly to a voice synthesizing apparatus for synthesizing voices of a song sung by a singer.

B) Description of the Related Art

Human voices are constituted of phonemes each constituted of a plurality of formants. In synthesizing voices of a song sung by a singer, first all formants constituting each of all phonemes capable of being produced by a singer are generated and synthesized to form each phoneme. Next, a plurality of generated phonemes are sequentially coupled and pitches are controlled in accordance with the melody to thereby synthesize voices of a song sung by a singer. This method is applicable not only to human voices but also to musical sounds produced by a musical instrument such as a wind instrument.

A voice synthesizing apparatus utilizing this method is already known. For example, Japanese Patent No. 2504172 discloses a formant sound generating apparatus which can generate a formant sound having even a high pitch without generating unnecessary spectra.

The above-described formant sound generating apparatus and conventional voice synthesizing apparatus cannot reproduce individual characters such as the voice quality, peculiarity and the like of each person if the pitch only is changed, although they can pseudonymously synthesize voices of a song sung by a general person.

SUMMARY OF THE INVENTION

It is an object of the present invention to provide a voice synthesizing apparatus capable of synthesizing voices of a song sung by a singer and reproducing individual characters such as the voice quality, peculiarity and the like of each singer.

It is another object of the present invention to provide a voice synthesizing apparatus capable of synthesizing more realistic voices of a song sung by a singer and singing the song in a state without unnaturalness.

According to one aspect of the present invention, there is provided a voice analyzing apparatus comprising: a first analyzer that analyzes a voice into harmonic components and inharmonic components: a second analyzer that analyzes a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and a memory that stores the inharmonic components, the magnitude spectrum envelope of the vocal cord vibration waveform, resonances and the spectrum envelope of the difference.

According to another aspect of the invention, there is provided a voice synthesizing apparatus comprising: a memory that stores a magnitude spectrum envelope of a vocal cord vibration waveform, resonances and a spectrum envelope of a difference of a magnitude spectrum envelope of a harmonic components from a sum of the magnitude spectrum envelope of the vocal cord vibration waveform and the resonances, respectively analyzed from the harmonic components analyzed from a voice and inharmonic components analyzed from the voice; an input device that inputs information of a voice to be synthesized; a generator that generates a flat magnitude spectrum envelope; and an adding device that adds the inharmonic components, the magnitude spectrum envelope of the vocal cord vibration waveform, resonances and the spectrum envelope of the difference, respectively read from said memory, to the flat magnitude spectrum envelope, in accordance with the input information.

According to yet another aspect of the invention, there is provided a voice synthesizing apparatus comprising: a first analyzer that analyzes a voice into harmonic components and inharmonic components: a second analyzer that analyzes a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and a memory that stores the inharmonic components, the magnitude spectrum envelope of the vocal cord vibration waveform, resonances and the spectrum envelope of the difference; an input device that inputs information of a voice to be synthesized; a generator that generates a flat magnitude spectrum envelope; and an adding device that adds the inharmonic components, the magnitude spectrum envelope of the vocal cord vibration waveform, resonances and the spectrum envelope of the difference, respectively read from said memory, to the flat magnitude spectrum envelope, in accordance with the input information.

As above, it is possible to provide a voice synthesizing apparatus capable of synthesizing human musical sounds and reproducing individual characters such as the voice quality, peculiarity and the like of each person.

It is also possible to provide a voice synthesizing apparatus capable of synthesizing more realistic voices of a song sung by a singer and singing a song in a state without unnaturalness.

DESCRIPTION OF THE PREFERRED EMBODIMENTS

Figure 1:
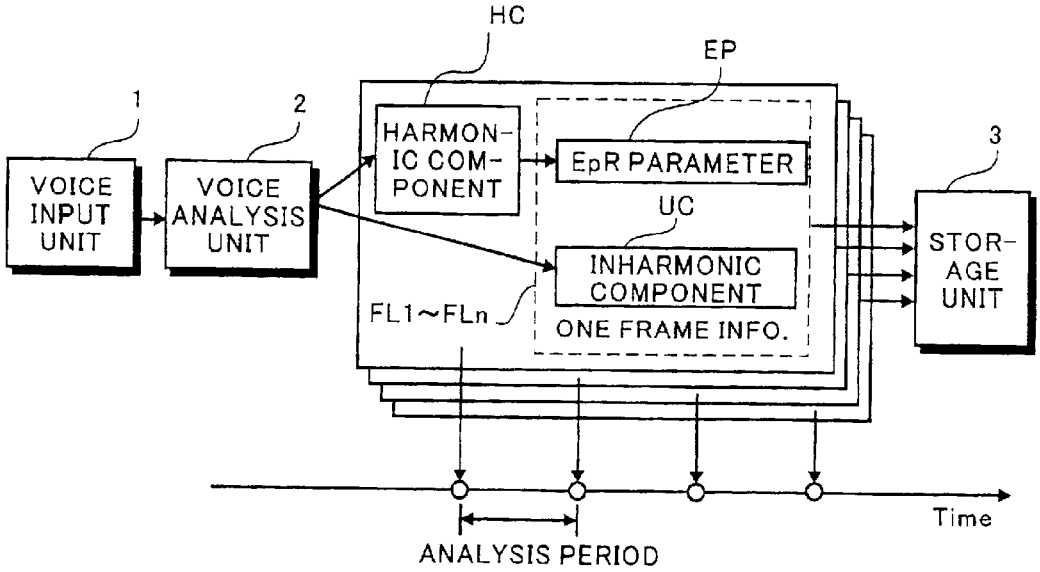
FIG. 1 is a diagram illustrating voice analysis according to an embodiment of the invention.

FIG. 1 is a diagram illustrating voice analysis.

Voices input to a voice input unit 1 are sent to a voice analysis unit 2. The voice analysis unit 2 analyzes the supplied voices every constant period. The voice analysis unit 2 analyzes an input voice into harmonic components HC and inharmonic components US, for example, by spectral modeling synthesis (SMS).

The harmonic components HC are components that can be represented by a sum of sine waves having some frequencies and magnitudes. Dots shown in FIG. 2 indicate the frequency and magnitude (sine components) of an input voice to be obtained as the harmonic components HC. In this embodiment, a set of straight lines interconnecting these dots is used as a magnitude spectrum envelope. The magnitude spectrum envelope is shown by a broken line in FIG. 2. A fundamental frequency Pitch can be obtained at the same time when the harmonic components HC are obtained.

Figure 3:
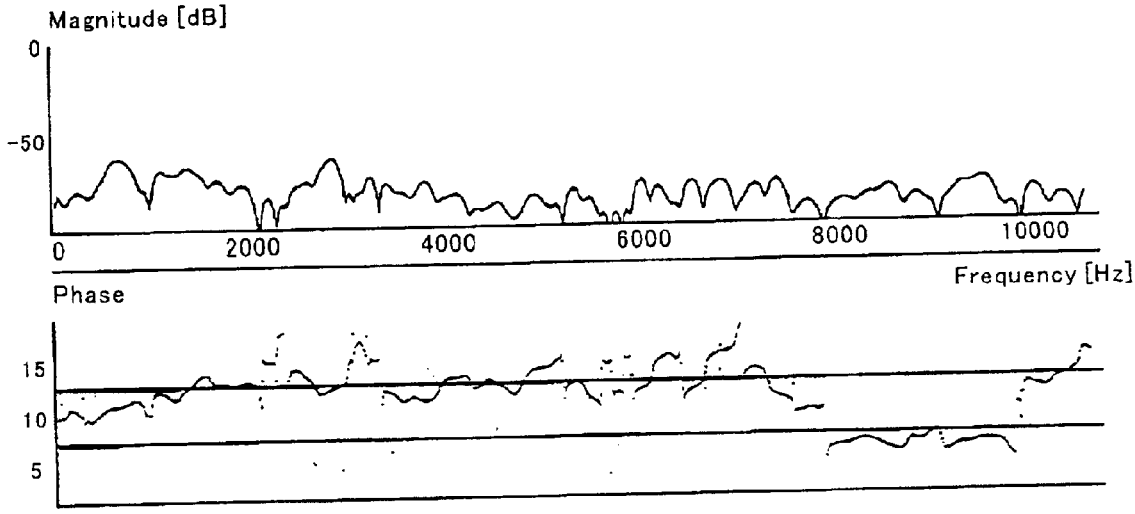
FIG. 3 is a graph showing a magnitude spectrum envelope of inharmonic components.

The inharmonic components UC are noise components of the input voice unable to be analyzed as the harmonic components HC. The inharmonic components UC are, for example, those shown in FIG. 3. The upper graph in FIG. 3 shows a magnitude spectrum representative of the magnitude of the inharmonic components UC, and the lower graph shows a phase spectrum representative of the phase of the inharmonic components UC. In this embodiment, the magnitudes and phases of the inharmonic components UC themselves are recorded as frame information FL.

The magnitude spectrum envelope of the harmonic components extracted through analysis is analyzed into a plurality of excitation plus resonance (EpR) parameters to facilitate later processes.

In this embodiment, the EpR parameters include four parameters: an Excitation Curve parameter, a Vocal Tract Resonance parameter, a Chest Resonance parameter, and a Spectral Shape Differential parameter. Other EpR parameters may also be used.

As will be later detailed, the Excitation Curve indicates a spectrum envelope of a vocal cord vibration waveform, and the Vocal Tract Resonance is an approximation of the spectrum shape (formants) formed by a vocal tract as a combination of several resonances. The Chest Resonance is an approximation of the formants of low frequencies other than the formants of the Vocal Tract Resonance formed as a combination of several resonances (particularly chest resonances).

The Spectral Shape Differential represents the components unable to be expressed by the above-described three EpR parameters. Namely, The Spectral Shape Differential is obtained by subtracting the Excitation Curve, Vocal Tract Resonance and Chest Resonance from the magnitude spectrum envelope.

The inharmonic components UC and EpR parameters are stored in a storage unit 3 as pieces of frame information FL1 to FLn.

Figure 4:
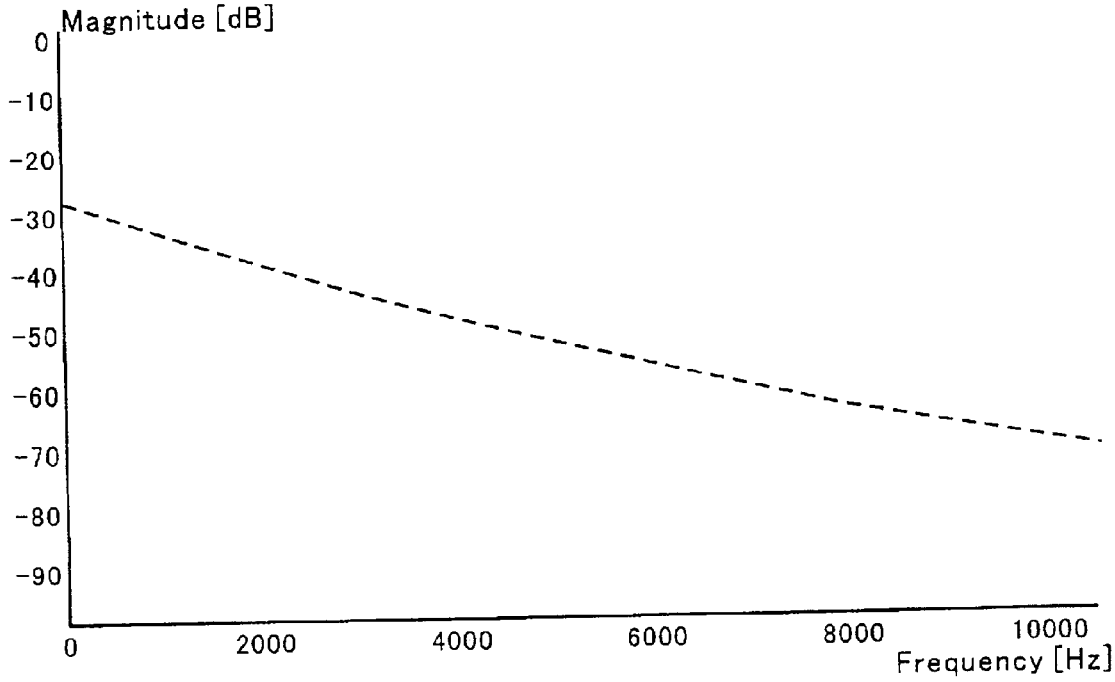
FIG. 4 is a graph showing spectrum envelopes of a vocal cord vibration waveform.

FIG. 4 is a graph showing the spectrum envelope (Excitation Curve) of a vocal code vibration waveform. The Excitation Curve corresponds to the magnitude spectrum envelope of a vocal cord vibration waveform.

More specifically, the Excitation Curve is constituted of three EpR parameters: an EGain [dB] representative of the magnitude of a vocal cord vibration waveform; an ESlope representative of a slope of the spectrum envelope of the vocal cord vibration waveform; and an ESlope Depth representative of a depth from the maximum value to minimum value of the spectrum envelope of the vocal cord vibration waveform.

By using these three EpR parameters, the magnitude spectrum envelope (Excitation Curve Mag dB) of the Excitation Curve at a frequency fHz can be given by the following equation:

$$\text{ExcitationCurveMag}_{dB}(f_{Hz})=E\text{Gain}_{dB}+E\text{SlopeDepth}_{dB}\cdot(e^{-E\text{Slope}\cdot f\text{HZ}}-1) \quad \text{(a)}$$

It can be understood from this equation (a) that EGain can genuinely change the signal magnitude of the magnitude spectrum envelope of the Excitation Curve, and ESlope and ESlope Depth can control the frequency characteristics (slope) of the signal magnitude of the magnitude spectrum envelope of the Excitation Curve.

Figure 5:
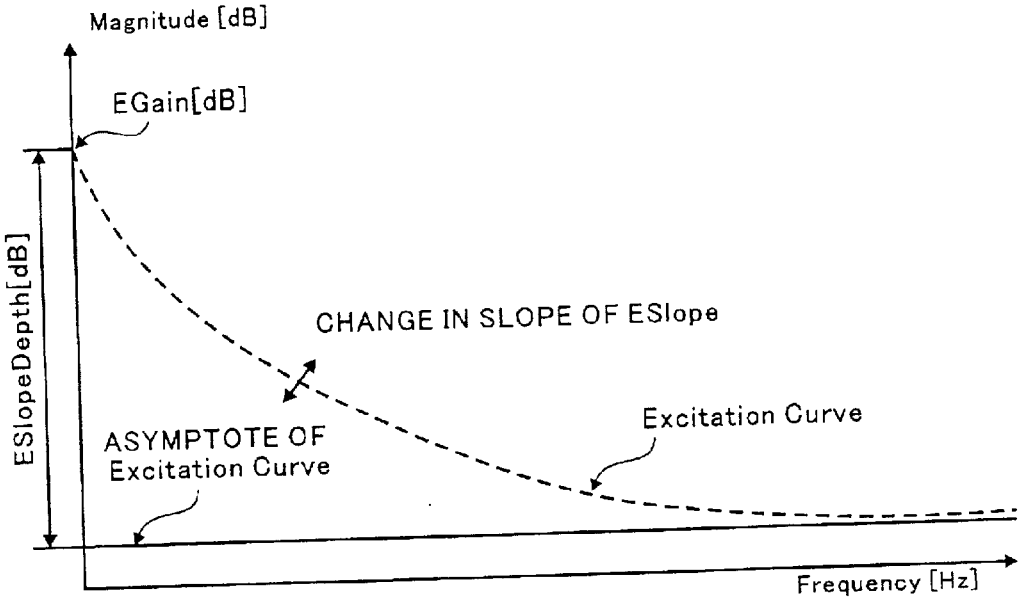
FIG. 5 is a graph showing a change in Excitation Curve.

FIG. 5 is a graph showing a change in Excitation Curve by the equation (a). The Excitation Curve extends starting from EGain [dB] at the frequency f=0 Hz along an asymptote of EGain ESlope Depth [dB]. ESlope determines the slope of the Excitation Curve.

Next, how EGain, ESlope and ESlope Depth are calculated will be described. In extracting the EpR parameters from the magnitude spectrum envelope of the original harmonic components HC, first the above-described three EpR parameters are calculated.

For example, EGain, ESlope and ESlope Depth are calculated by the following method.

First, the maximum magnitude of the original harmonic components HC at the frequency of 250 Hz or lower is set to MAX [dB] and MIN is set to −100 [dB].

Next, the magnitude and frequency of the i-th sine components of the original harmonic components HC at the frequency of 10,000 Hz are set to Sin Mag [1] [dB] and Sin Freq [i] [Hz], and the number of sine components at the frequency of 10,000 Hz is set to N. The averages are calculated from the following equations (b1) and (b2) where Sin Freq [0] is the lowest frequency of the sine components:

$$XAverage = \frac{\sum_{i=0}^{i=N-1} (SinFreq[i] - SinFreq[0])}{N} \quad (b1)$$

$$YAverage = \frac{\sum_{i=0}^{i=N-1} (\log(SinMag[i] - MIN))}{N} \quad (b2)$$

By using the equations (b1) and (b2), the following equations are set:

$$a=\log(MAX-MIN) \quad (b3)$$

$$b=(a-YAverage)/XAverage \quad (b4)$$

$$A=e^{a} \quad (b5)$$

$$B=-b \quad (b6)$$

$$A0=A\cdot e^{-B\cdot SinFreq[0]} \quad (b7)$$

By using the equations (b3) to (b7), EGain, ESlope and ESlope Depth are calculated by the following equations (b8), (b9) and (b10):

$$EGain=A0+MIN \quad (b8)$$

$$ESlopeDepth=A0 \quad (b9)$$

$$ESlope=B \quad (b10)$$

The EpR parameters of EGain, ESlope and ESlope Depth can be calculated in the manner described above.

Figure 6:
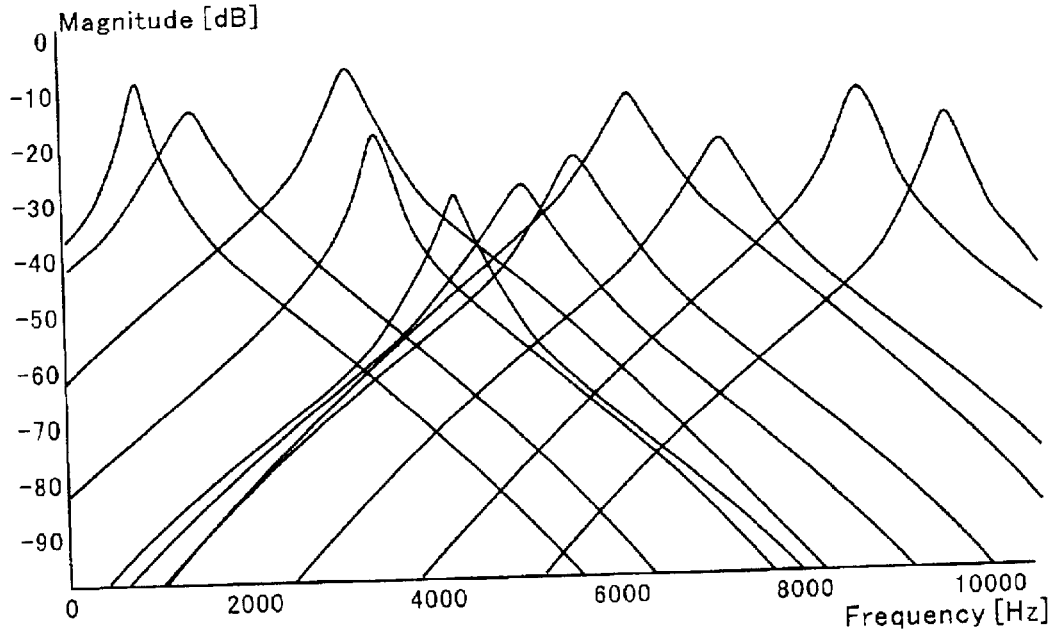
FIG. 6 is a graph showing spectrum envelopes formed by Vocal Tract Resonance.

FIG. 6 is a graph showing a spectrum envelope formed by Vocal Tract Resonance. The Vocal Tract Resonance is an approximation of the spectrum shape (formants) formed by a vocal tract as a combination of several resonances.

For example, a difference between phonemes such as "a" and "i" produced by a human corresponds to a difference of the shapes of mountains of a magnitude spectrum envelope mainly caused by a change in the shape of the vocal tract. This mountain is called a formant. An approximation of formants can be obtained by using resonances.

In the example shown in FIG. 6, formants are approximated by using eleven resonances. The i-th resonance is represented by Resonance [i] and the magnitude of the i-th resonance at a frequency f is represented by Resonance [i] Mag (f). The magnitude spectrum envelope of Vocal Tract Resonance can be given by the following equation (c1):

$$VocalTractResonannceMag_{dB}(f_{Hz}) = TodB\left(\sum_i Resonance[i]Mag_{linear}(f_{Hz})\right) \quad (c1)$$

By representing the phase of the i-th resonance by Resonance [i] Phase [f], the phase (phase spectrum) of Vocal Tract Resonance can be given by the following equation (c2):

$$VocalTractResonanncePhase(f_{Hz}) = \sum_i Resonance[i]Phase(f_{Hz}) \quad (c2)$$

Each Resonance [i] can be expressed by three EpR parameters: a center frequency F, a bandwidth Bw and an amplitude Amp. How a resonance is calculated will be later described.

Figure 7:
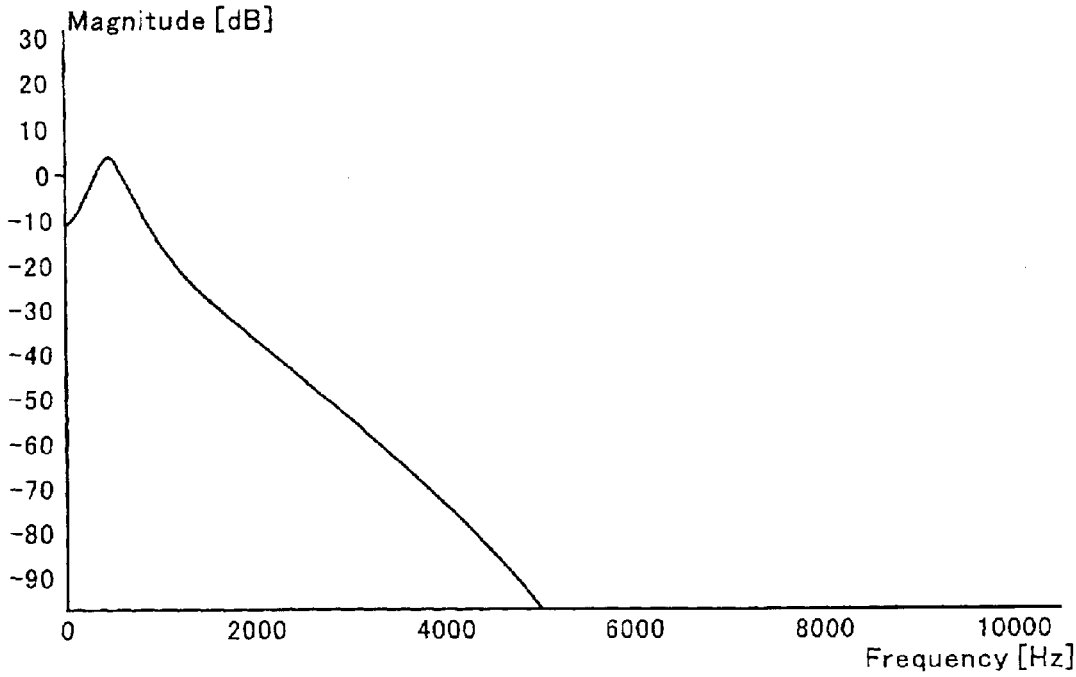
FIG. 7 is a graph showing a spectrum envelope of a Chest Resonance waveform.

FIG. 7 is a graph showing a spectrum envelope (Chest Resonance) of a chest resonance waveform. Chest Resonance is formed by a chest resonance and expressed by mountains (formants) of the magnitude spectrum envelope at low frequencies unable to be represented by Vocal Tract Resonance, the mountains (formants) being formed by using resonances.

The i-th resonance of chest resonances is represented by CResonance [i] and the magnitude of the i-th resonance at a frequency f is represented by CResonance [i] Mag (f). The magnitude spectrum envelope of Chest Resonance can be given by the following equation (d):

$$ChestResonanceMag_{dB}(f_{Hz}) = TodB\left(\sum_i CResonance[i]Mag_{linear}(f_{Hz})\right) \quad (d)$$

Each CResonance [i] can be expressed by three EpR parameters: a center frequency F, a bandwidth Bw and an amplitude Amp. How a resonance is calculated will be described.

Each resonance (Resonance [i], CResonance [i] of Vocal Tract Resonance and Chest Resonance) can be defined by three EpR parameters: the central frequency F, bandwidth Bw and amplitude Amp.

The transfer function of a z-area of a resonance having the central frequency F and band width Bw can be expressed by the following equation (e1):

$$T(z) = \frac{A}{1 - Bz^{-1} - Cz^{-2}} \quad (e1)$$

where:

$$z=e^{j2\pi fT} \quad (e2)$$

$$T=Samplingperiod \quad (e3)$$

$$C=-e^{-2\pi fT} \quad (e4)$$

$$B=2e^{2\pi fT}\cos(2\pi fT) \quad (e5)$$

$$A=1-B-C \quad (e6)$$

This frequency response can be expressed by the following equation (e7):

$$T(f) = \frac{1 - B - C}{1 - B\cos(2\pi fT) - C\cos(4\pi fT) + j\,[B\sin(2\pi fT) + C\sin(4\pi fT)]} \quad (e7)$$

Figure 8:
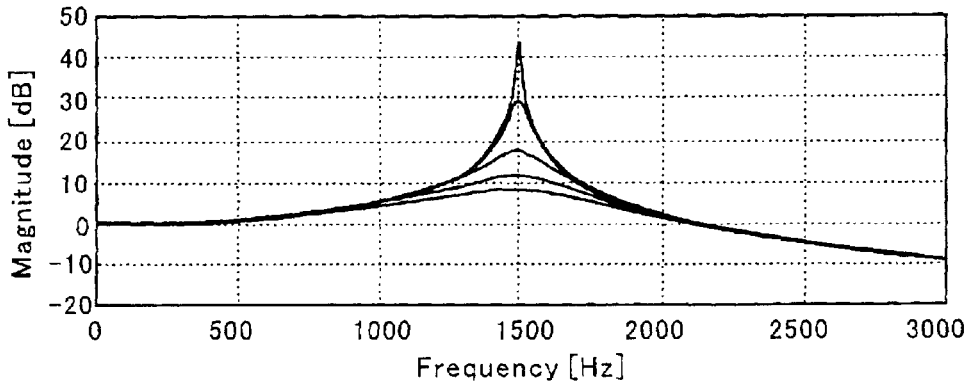
FIG. 8 is a graph showing the frequency characteristics of resonances.

FIG. 8 is a graph showing examples of the frequency characteristics of resonances. In these examples, the resonance center frequency F was 1500 Hz, and the bandwidth Bw and amplitude Amp were changed.

As shown in FIG. 8, the amplitude |T(f)| becomes maximum at a frequency f=the central frequency F. This maximum value is the resonance amplitude Amp. The Resonance (f) (linear value) of a resonance having the central frequency F, band width Bw and amplitude Amp (linear value) represented by the equation (e7) can be given by the following equation (e8):

$$Resonance(f_{Hz}) = \frac{Amp_{linear}}{|T(F_{Hz})|} \cdot T(f_{Hz}) \quad (e8)$$

The magnitude of resonance at the frequency f can therefore be given by the following equation (e9) and the phase can be given by the following equation (e10):

$$\text{ResonanceMag}_{linear}(f_{Hz})=|\text{Resonance}(f_{Hz})| \quad \text{(e9)}$$

$$\text{ResonancePhase}(f_{Hz})=\angle\text{Resonance}(f_{Hz})=\text{Resonance}(f_{Hz}) \quad \text{(e10)}$$

Figure 9:
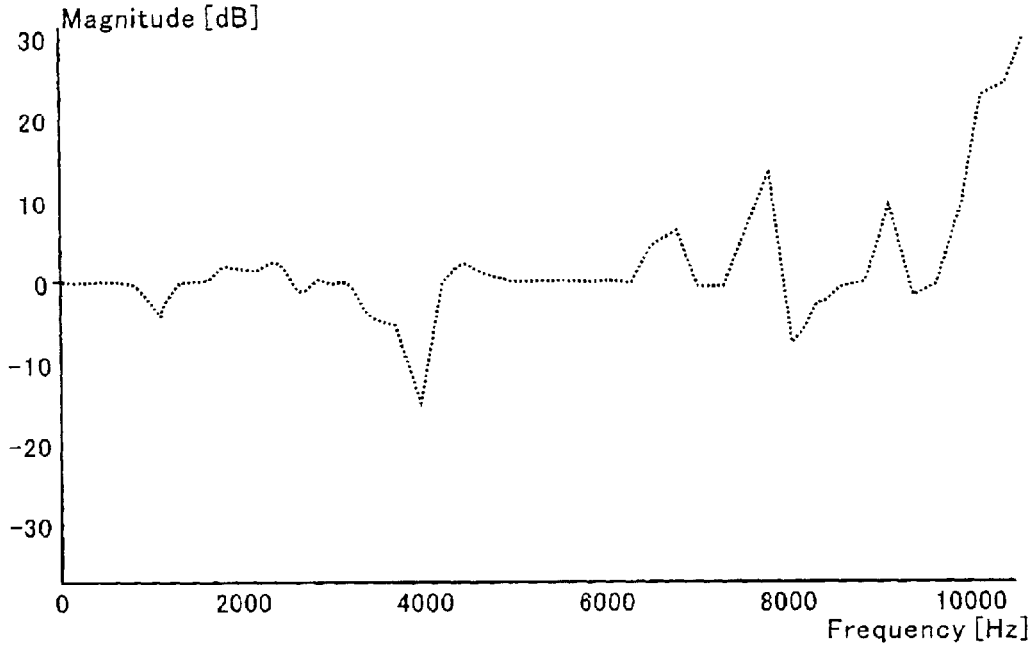
FIG. 9 is a graph showing an example of Spectral Shape Differential.

FIG. 9 shows an example of Spectral Shape Differential. Spectral Shape Differential corresponds to the components of the magnitude spectrum envelope of the original input voice unable to be expressed by Excitation Curve, Vocal Tract Resonance and Chest Resonance.

By representing these components by Spectral Shape Differential Mag (f) [dB], the following equation (f) is satisfied:

$$\text{OrgMag}_{dB}(f_{Hz})=\text{ExcitationCurveMag}_{dB}(f_{Hz})+\text{ChestResonanceMag}_{dB}(f_{Hz})+\text{VocalTractResonanceMag}_{dB}(f_{Hz})+\text{SpectralShapeDifferentialMag}_{dB}(f_{Hz}) \quad \text{(f)}$$

Namely, Spectral Shape Differential is a difference between the other EpR parameters and the original harmonic components, this difference being calculated at a constant frequency interval. For example, the difference is calculated at a 50 Hz interval and a straight-line interpolation is performed between adjacent points.

The magnitude spectrum envelope of the harmonic components of the original input voice can be reproduced from the equation (f) by using the EpR parameters.

Approximately the same original input voice can be recovered by adding the inharmonic components to the magnitude spectrum envelope of the reproduced harmonic components.

Figure 2:
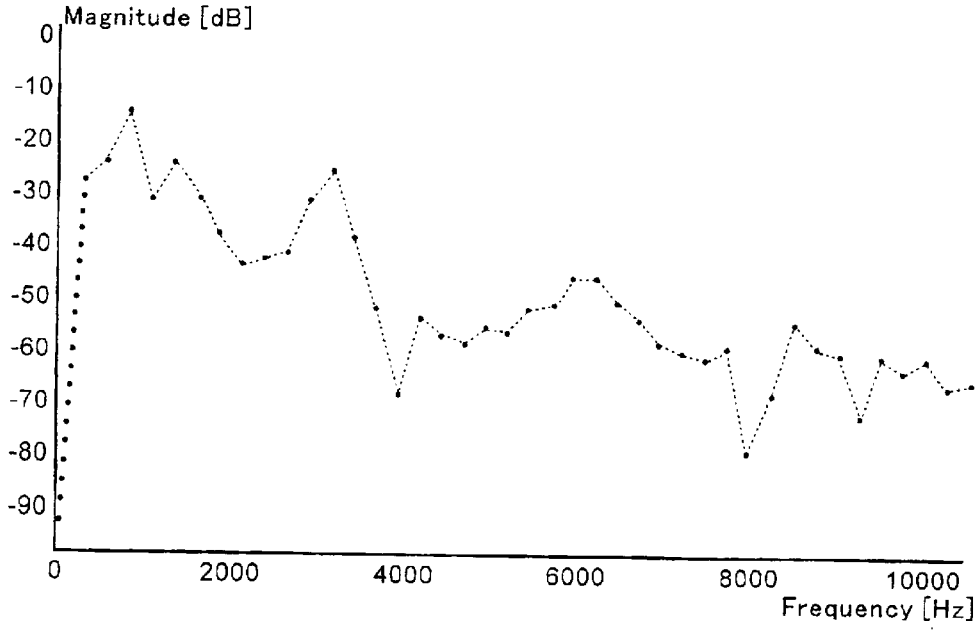
FIG. 2 is a graph showing a spectrum envelope of harmonic components.
Figure 10:
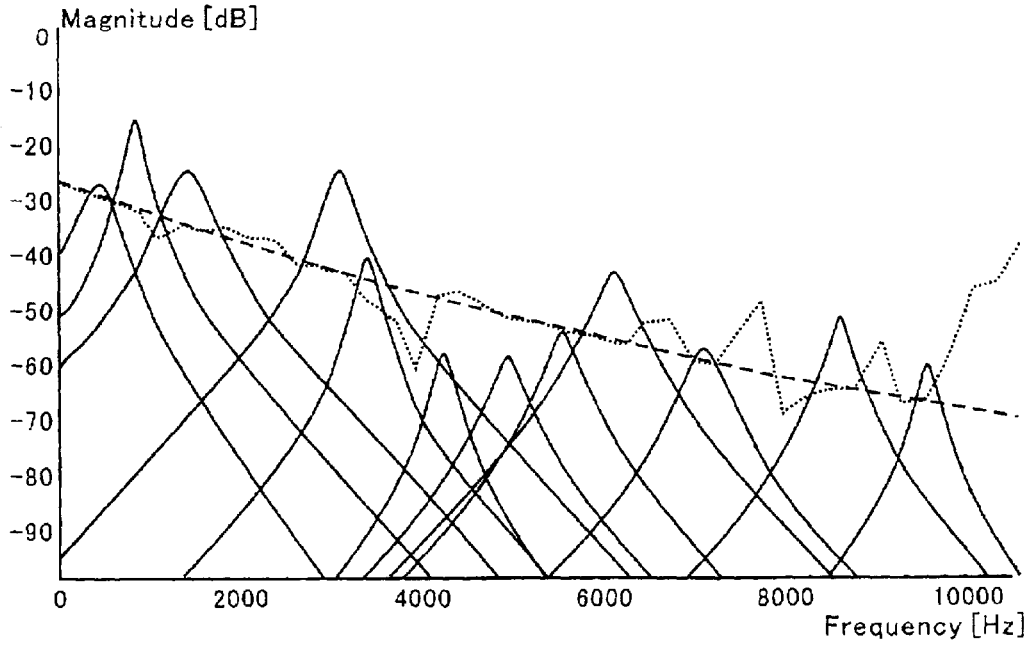
FIG. 10 is a graph showing the magnitude spectrum envelope of the harmonic components HC shown in FIG. 2 analyzed into EpR parameters.

FIG. 10 is a graph showing the magnitude spectrum envelope of the harmonic components HC shown in FIG. 2 analyzed into EpR parameters.

FIG. 10 shows: Vocal Tract Resonance corresponding to the resonances having the center frequency higher than the second mountain shown in FIG. 6; Chest Resonance corresponding to the resonance having the lowest center frequency shown in FIG. 7; Spectral Shape Differential indicated by a dotted line shown in FIG. 9; and Excitation Curve indicated by a bold broken line.

The resonances corresponding to Vocal Tract Resonance and Chest Resonance are added to Excitation Curve. Spectral Shape Differential has a difference value of 0 on Excitation Curve.

Next, how the whole spectrum envelope changes if Excitation Curve is changed will be described.

Figure 11A:
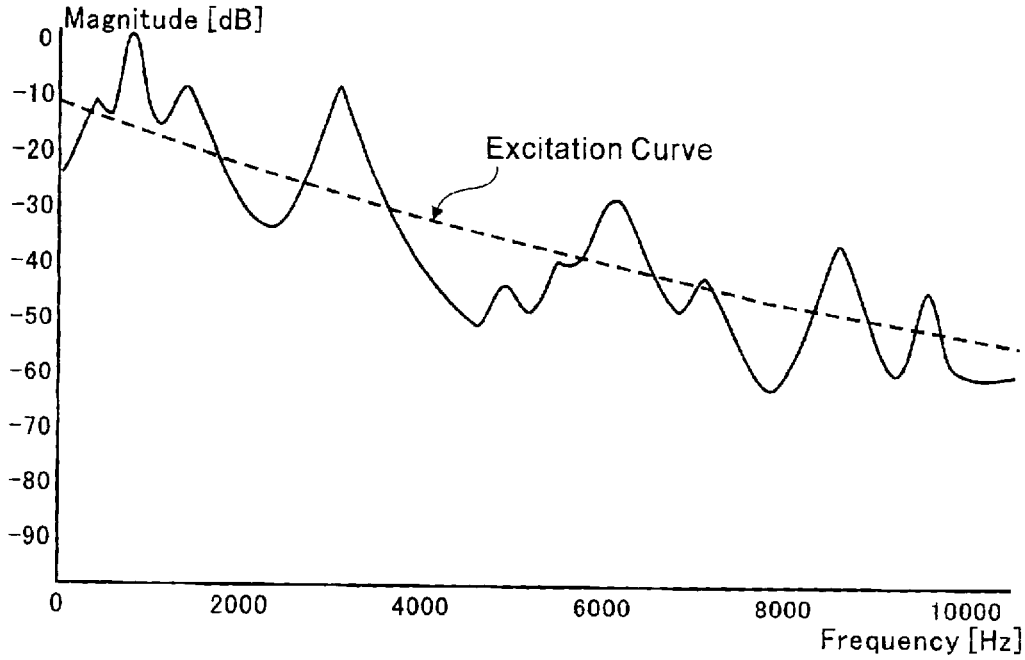
FIGS. 11A and 11B are graphs showing examples of the total spectrum envelope when EGain of the Excitation Curve shown in FIG. 10 is changed.
Figure 11B:
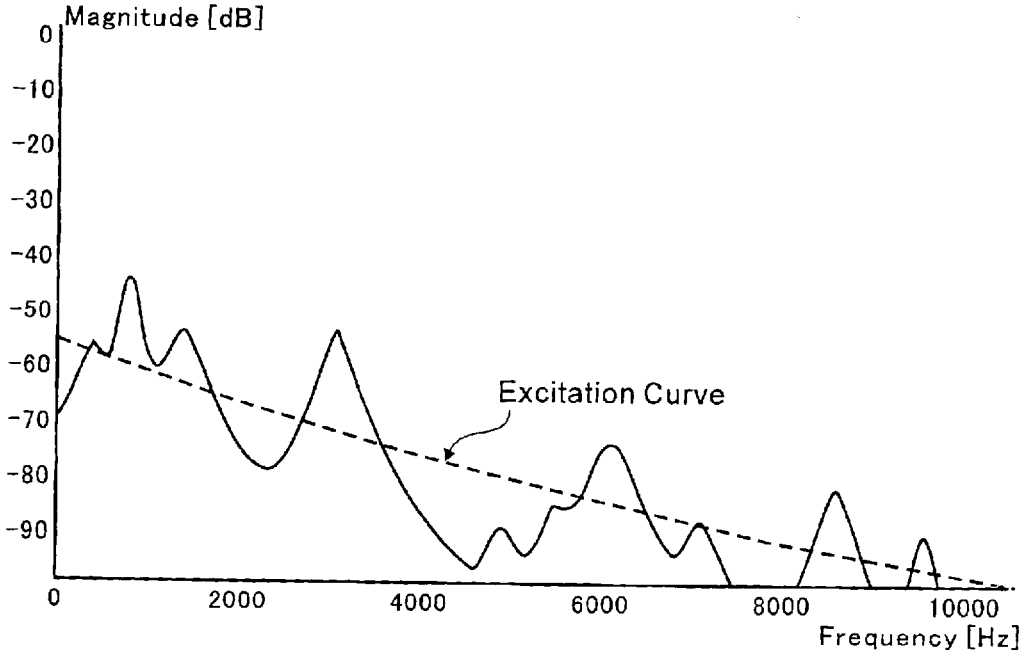

FIGS. 11A and 11B show examples of the whole spectrum envelope when EGain of Excitation Curve shown in FIG. 10 is changed.

As shown in FIG. 11A, as EGain is made large, the gain (magnitude) of the whole spectrum envelope becomes large. However, since the shape of the spectrum envelope does not change, the tone color is not changed. Only the volume can therefore be made large.

As shown in FIG. 11B, as EGain is made small, the gain (magnitude) of the whole spectrum envelope becomes small. However, since the shape of the spectrum envelope does not change, the tone color is not changed. Only the volume can therefore be made small.

Figure 12A:
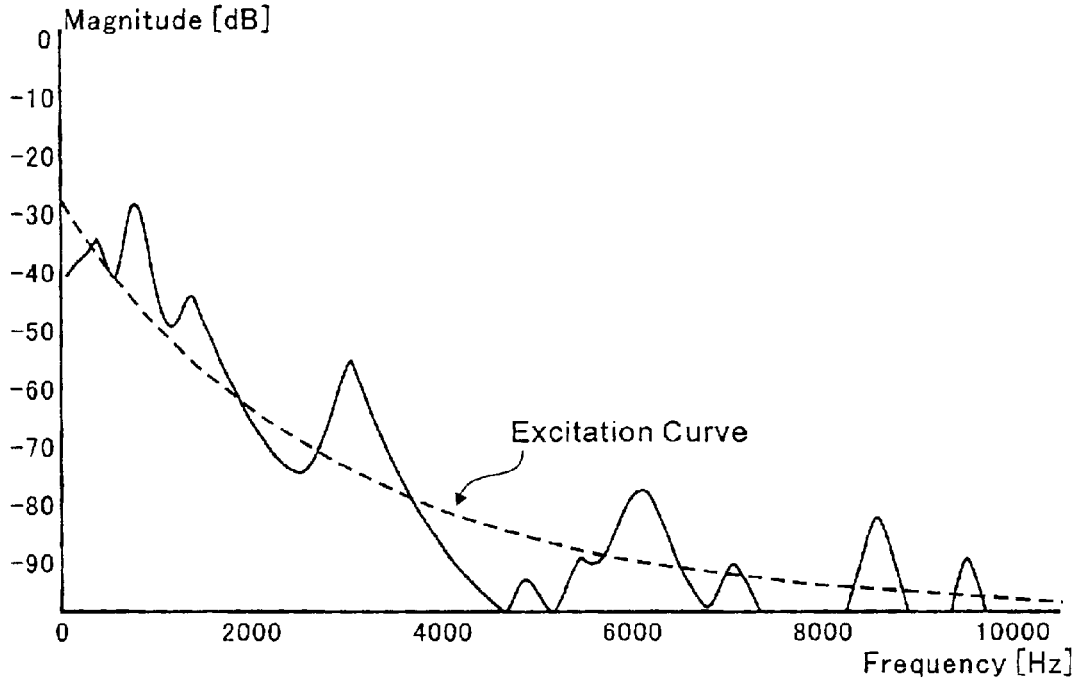
FIGS. 12A and 12B are graphs showing examples of the total spectrum envelope when ESlope of the Excitation Curve shown in FIG. 10 is changed.
Figure 12B:
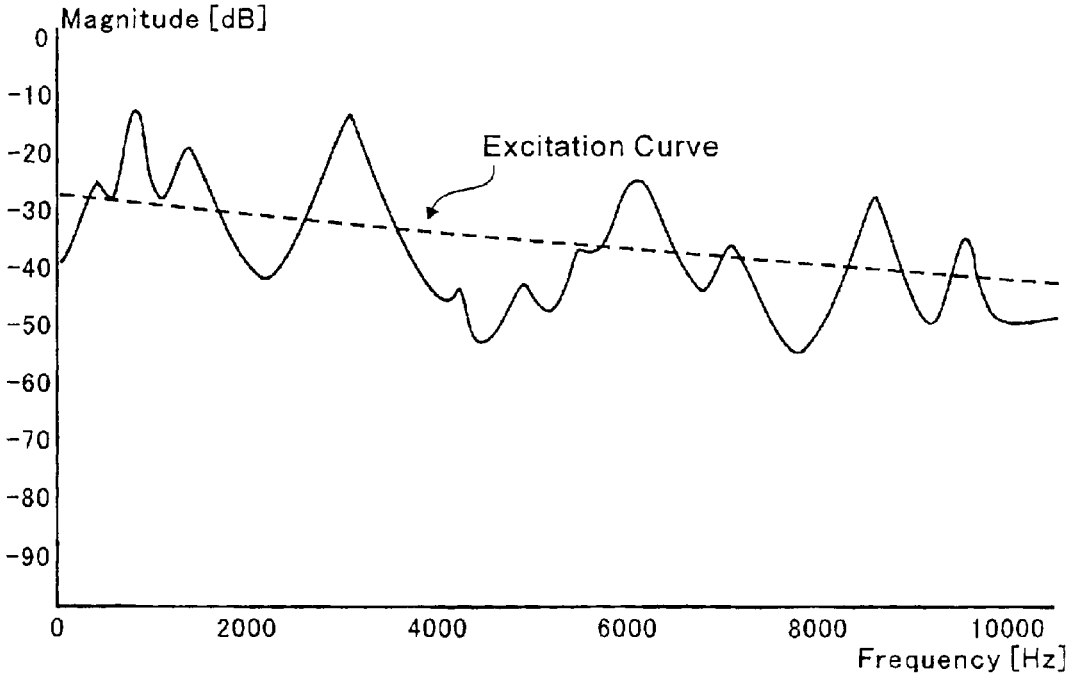

FIGS. 12A and 12B show examples of the whole spectrum envelope when ESlope of Excitation Curve shown in FIG. 10 is changed.

As shown in FIG. 12A, as ESlope is made large, although the gain (magnitude) of the whole spectrum envelope does not change, the shape of the spectrum envelope changes so that the tone color changes. By setting ESlope large, the unclear tone color with a suppressed high frequency range can be obtained.

As shown in FIG. 12B, as ESlope is made small, although the gain (magnitude) of the whole spectrum envelope does not change, the shape of the spectrum envelope changes so that the tone color changes. By setting ESlope small, the bright tone color with an enhanced high frequency range can be obtained.

Figure 13A:
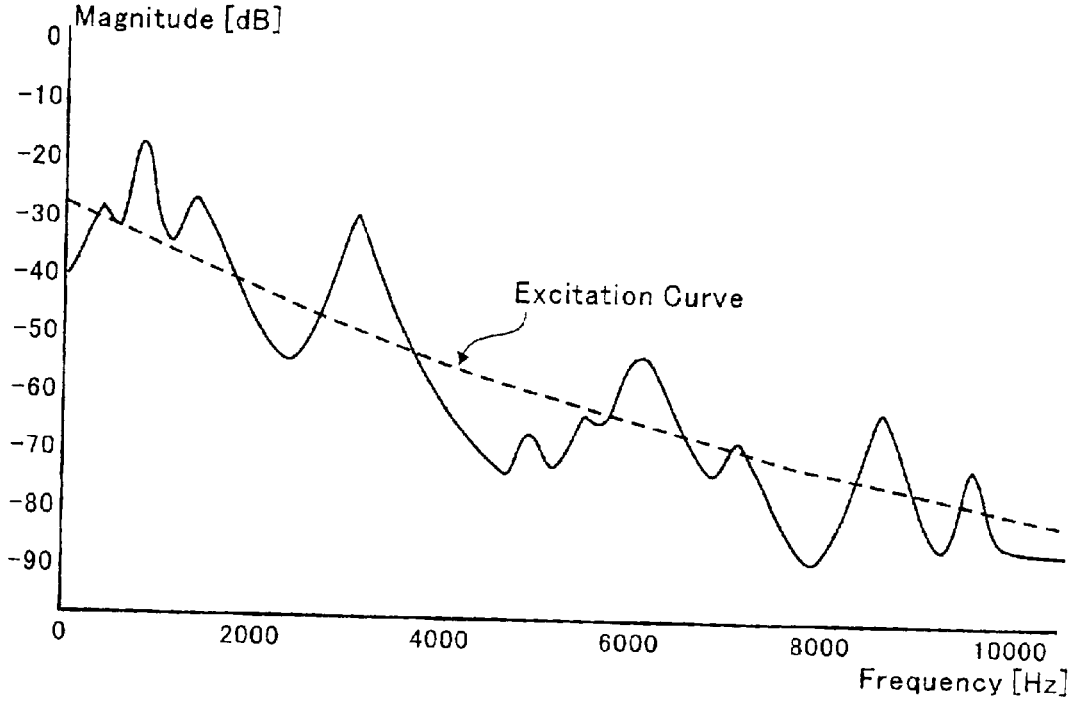
FIGS. 13A and 13B are graphs showing examples of the total spectrum envelope when ESlope Depth of the Excitation Curve shown in FIG. 10 is changed.
Figure 13B:
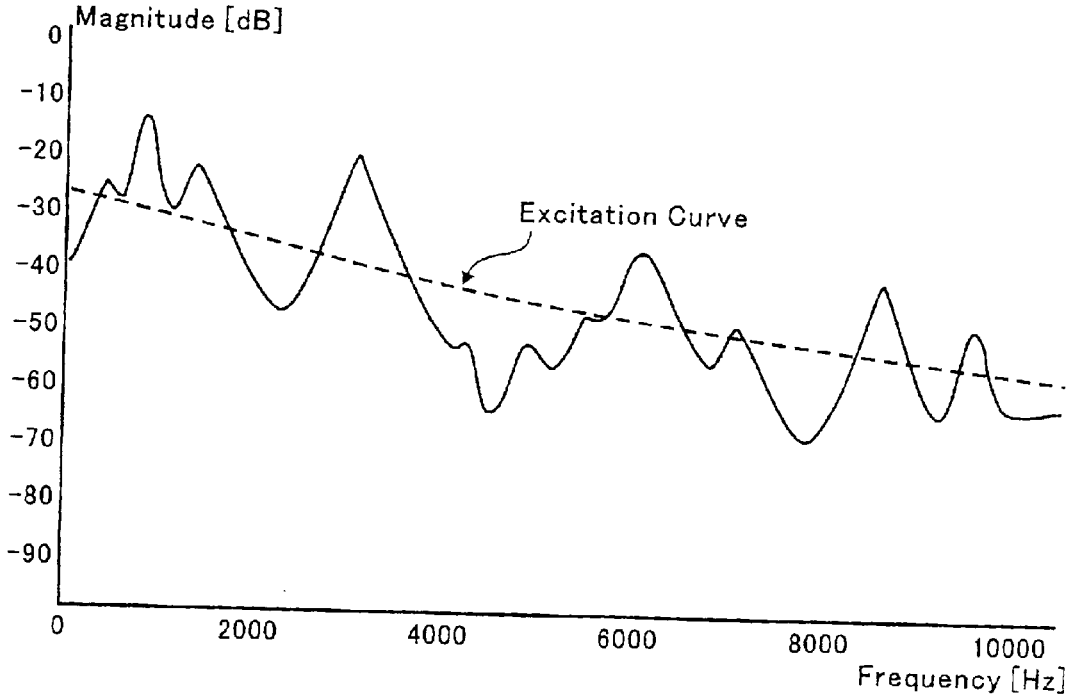

FIGS. 13A and 13B show examples of the whole spectrum envelope when ESlope Depth of Excitation Curve shown in FIG. 10 is changed.

As shown in FIG. 13A, as ESlope Depth is made large, although the gain (magnitude) of the whole spectrum envelope does not change, the shape of the spectrum envelope changes so that the tone color changes. By setting ESlope Depth large, the unclear tone color with a suppressed high frequency range can be obtained.

As shown in FIG. 13B, as ESlope Depth is made small, although the gain (magnitude) of the whole spectrum envelope does not change, the shape of the spectrum envelope changes so that the tone color changes. By setting ESlope Depth small, the bright tone color with an enhanced high frequency range can be obtained.

The effects of changing ESlope and ESlope Depth are very similar.

Next, a method of simulating a change in tone color of real voice when EpR parameters are changed will be described. For example, assuming that one-frame phoneme data of a voiced sound such as "a" is represented by the EpR parameters and Dynamics (the volume of voice production), a change in tone color to be changed by Dynamics of real voice production is simulated by changing EpR parameters. Generally, voice production at a small volume suppresses high frequency components, and the larger the volume becomes, the more the high frequency components increase, although this changes from one voice producer to another.

Figure 14A:
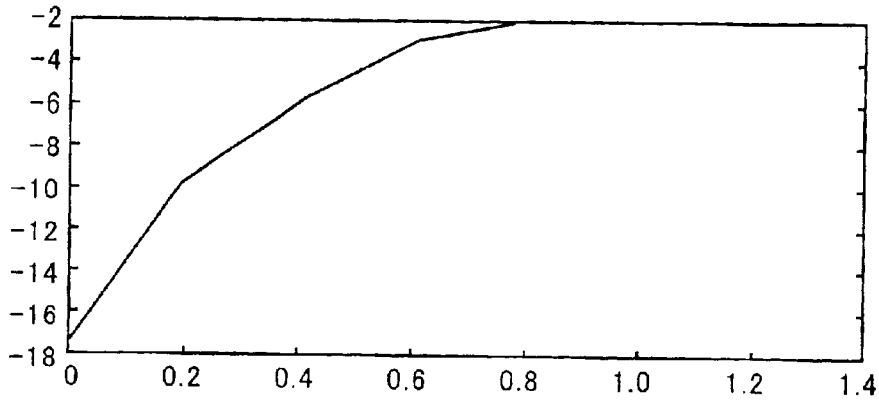
FIGS. 14A to 14C are graphs showing a change in EpR with a change in Dynamics.
Figure 14B:
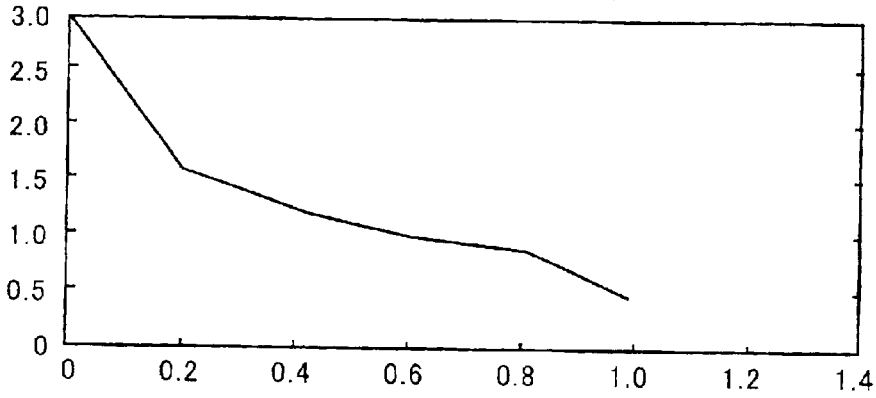
Figure 14C:
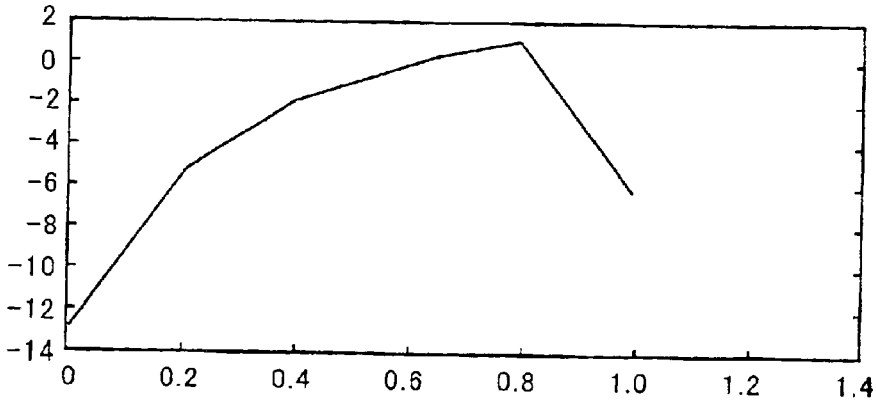

FIGS. 14A to 14C are graphs showing a change in EpR parameters as Dynamics is changed. FIG. 14A shows a change in EGain, FIG. 14B shows a change in ESlope, and FIG. 14C shows a change in ESlope Depth.

The abscissa in FIGS. 14A to 14C represents a value of Dynamics from 0 to 1.0. The Dynamics value 0 represents the smallest voice production, the Dynamics value 1.0 represents the largest voice production, and the Dynamics value 0.5 represents a normal voice production.

A database Timbre DB to be described later stores EGain, ESlope and ESlope Depth for the normal voice production, these EpR parameters being changed in accordance with the functions shown in FIGS. 14A to 14C. More specifically, the function shown in FIG. 14A is represented by FEGain (Dynamics), the function shown in FIG. 14B is represented by FESlope (Dynamics), and the function shown in FIG. 14C is represented by FESlope Depth (Dynamics). If a Dynamics parameter is given, the parameters can be expressed by the following equations (g1) to (g3):

$$\text{New}E\text{Gain}_{dB}=FE\text{Gain}_{dB}(\text{Dynamics}) \quad \text{(g1)}$$

$$\text{New}E\text{slope}=\text{Original}E\text{Slope}*FE\text{Slope}(\text{Dynamics}) \quad \text{(g2)}$$

$$\text{New}E\text{SlopeDepth}_{dB}=\text{Original}E\text{SlopeDepth}_{dB}+FE\text{SlopeDepth}_{dB}(\text{Dynamics}) \quad \text{(g3)}$$

where Original ESlope and Original ESlope Depth are the original EpR parameters stored in the database Timbre DB.

The functions shown in FIGS. 14A to 14C are obtained by analyzing the parameters of the same phoneme reproduced at various degrees of voice production (Dynamics). By using these functions, the EpR parameters are changed in accordance with Dynamics. It can be considered that the changes shown in FIGS. 14A to 14C may differ for each phoneme, each voice producer and the like. Therefore, by making the function for each phoneme and each voice producer, a change analogous to more realistic voice production can be obtained.

Next, with reference to FIG. 15, a method of reproducing a change in tone color when Opening of a mouth is changed for the voice production of the same phoneme will be described.

Figure 15:
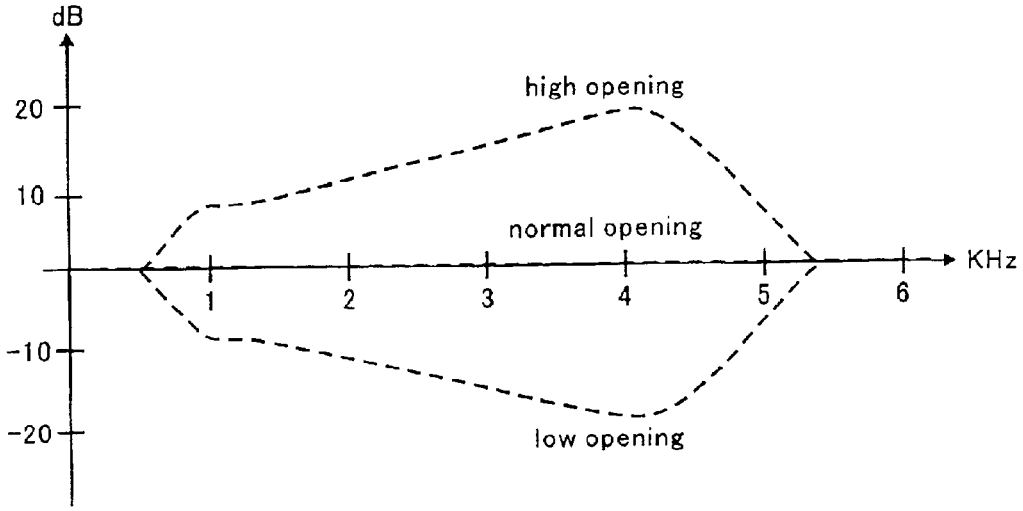
FIG. 15 is a graph showing a change in the frequency characteristics when Opening is changed.

FIG. 15 is a graph showing a change in frequency characteristics when Opening is changed. Similar to Dynamics, the Opening parameter is assumed to take values from 0 to 1.0.

The Opening value 0 represents the smallest opening of a mouse (low opening), the Opening value 1.0 represents the largest opening of a mouth (high opening), and the Opening value 0.5 represents a normal opening of a mouth (normal opening).

The database Timbre DB to be described later stores EpR parameters obtained when a voice is produced at the normal mouse opening. The EpR parameters are changed so that they have the frequency characteristics shown in FIG. 15 at the desired mouse opening degree.

In order to realize this change, the amplitude (EpR parameter) of each resonance is changed as shown in FIG. 15. For example, the frequency characteristics are not changed when a voice is produced at the normal mouth opening degree (normal opening). When a voice is produced at the smallest mouth opening degree (low opening), the amplitudes of the components at 1 to 5 KHz are lowered. When a voice is produced at the largest mouth opening degree (high opening), the amplitudes of the components at 1 to 5 KHz are raised.

This change function is represented by FOpening (f). The EpR parameters can be changed so that they have the frequency characteristics at the desired mouse opening degree, i.e. the frequency characteristics such as shown in FIG. 15, by changing the amplitude of each resonance by the following equation (h):

$$\text{NewResonance}[i]\text{Amp}_{dB}=\text{OriginalResonance}[i]\text{Amp}_{dB}+F\text{Opening}_{dB}(\text{OriginalResonance}[i]\text{Freq}_{Hz})\cdot(0.5-\text{Opening})/0.5 \quad \text{(h)}$$

The function FOpening (f) is obtained by analyzing the parameters of the same phoneme produced at various mouth opening degrees. By using this function, the EpR parameters are changed in accordance with the Opening values. It can be considered that this change may differ for each phoneme, each voice producer and the like. Therefore, by making the function for each phoneme and each voice producer, a change analogous to more realistic voice production can be obtained.

The equation (h) corresponds to the i-th resonance. Original Resonance [i] Amp and Original Resonance [i] Freq represent respectively the amplitude and center frequency (EpR parameters) of the resonance stored in the database Timbre DB. New Resonance [i] Amp represents the amplitude of a new resonance.

Next, how a song is synthesized will be described with reference to FIG. 16.

Figure 16:
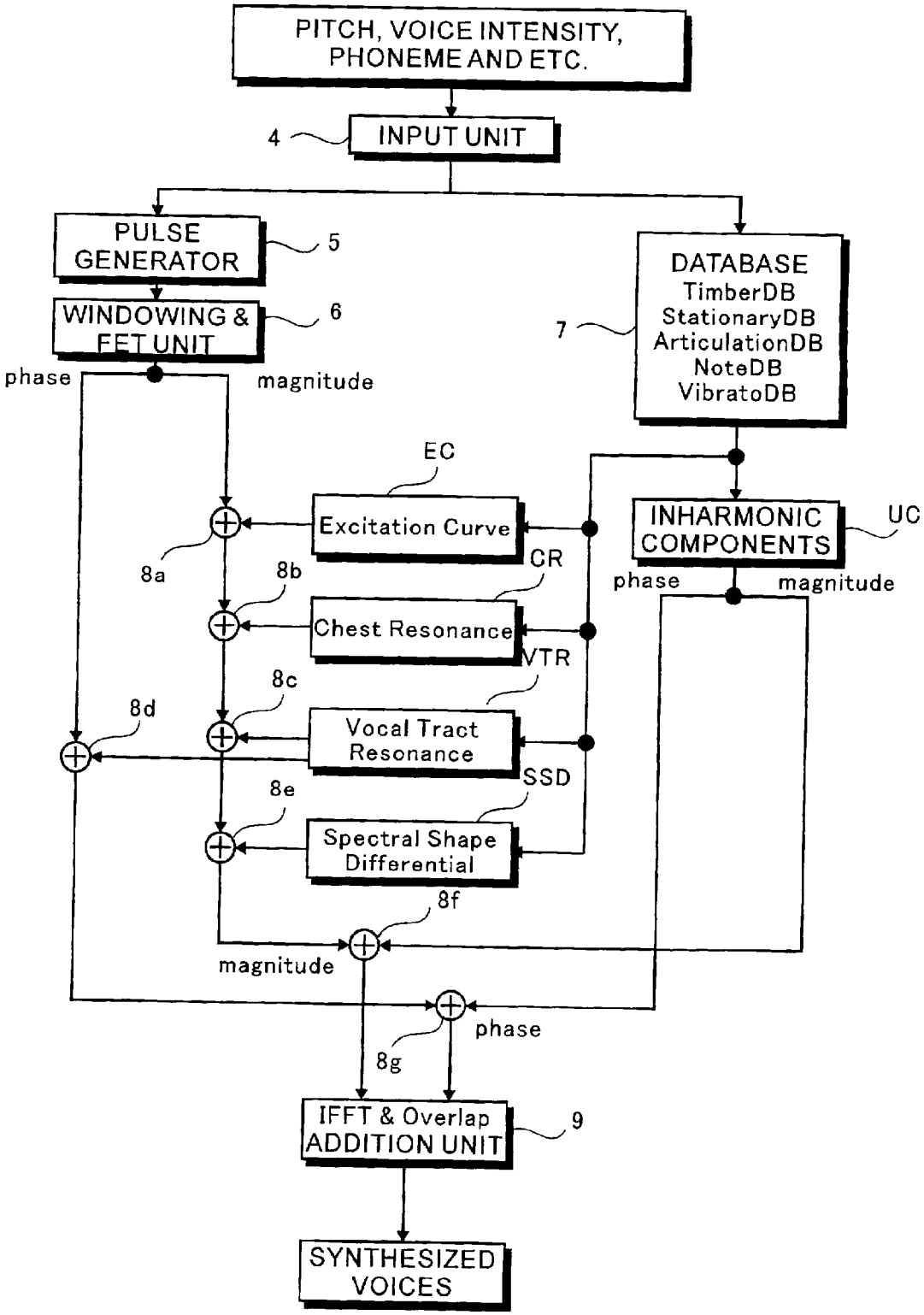
FIG. 16 is a block diagram of a song-synthesizing engine of a voice synthesizing apparatus.

FIG. 16 is a block diagram of a song-synthesizing engine of a voice synthesizing apparatus. The song-synthesizing engine has at least an input unit 4, a pulse generator unit 5, a windowing & FFT unit 6, a database 7, a plurality of adder units 8*a* to 8*g* and an IFFT & overlap unit 9.

The input unit 4 is input with a pitch, a voice intensity, a phoneme and other information in accordance with a melody of a song sung by a singer, at each frame period, for example, 5 ms. The other information is, for example, vibrato information including vibrato speed and depth. Information input to the input unit 4 is branched to two series to be sent to the pulse generator unit 5 and database 7.

The pulse generator unit 5 generates, on the time axis, pulses having a pitch interval corresponding to a pitch input from the input unit 4. By changing the gain and pitch interval of the generated pulses to provide the generated pulses themselves with a fluctuation of the gain and pitch interval, so called harsh voices and the like can be produced.

If the present frame is a voiceless sound, there is no pitch so that the process by the pulse generator unit 5 is not necessary. The process by the pulse generator unit 5 is performed only when a voiced sound is produced.

The windowing & FFT unit 6 windows a pulse (time waveform) generated by the pulse generator unit 5 and then performs fast Fourier transform to convert the pulse into frequency range information. A magnitude spectrum of the converted frequency range information is flat over the whole range. An output from the windowing & FFT unit 6 is separated into the phase spectrum and magnitude spectrum.

The database 7 prepares several databases to be used for synthesizing voices of a song. In this embodiment, the database 7 prepares Timbre DB, Stationary DB, Articulation DB, Note DB and Vibrato DB.

In accordance with the information input to the input unit 4, the database 7 reads necessary databases to calculate EpR parameters and inharmonic components necessary for synthesis at some timings. Timbre DB stores typical EpR parameters of one frame for each phoneme of a voiced sound (vowel, nasal sound, voiced consonant). It also stores EpR parameters of one frame of the same phoneme corresponding to each of a plurality of pitches. By using these pitches and interpolation, EpR parameters corresponding to a desired pitch can be obtained.

Stationary DB stores stable analysis frames of several seconds for each phoneme produced in a prolonged manner, as well as the harmonic components (EpR parameters) and inharmonic components. For example, assuming that the frame interval is 5 ms and the stable sound production time is 1 sec, then Stationary DB stores information of 200 frames for each phoneme.

Since Stationary DB stores EpR parameters obtained through analysis of an original voice, it has information such as fine fluctuation of the original voice. By using this information, fine change can be given to EpR parameters obtained from Timbre DB. It is therefore possible to reproduce the natural pitch, gain, resonance and the like of the original voice. By adding inharmonic components, more natural synthesized voices can be realized.

Articulation stores an analyzed change part from one phoneme to another phoneme as well as the harmonic components (EpR parameters) and inharmonic components. When a voice changing from one phoneme to another phoneme is synthesized, Articulation is referred to and a change in EpR parameters and the inharmonic components is used for this changing part to reproduce a natural phoneme change.

Note DB is constituted of three databases, Attack DB, Release DB and Note Transition DB. They store information of a change in gain (EGain) and pitch and other information obtained through analysis of an original voice (real voice), respectively for a sound production start part, a sound release part, and a note transition part.

For example, if a change in gain (EGain) and pitch stored in Attack DB is added to EpR parameters for the sound production start part, the change in gain and pitch like natural real voice can be added to the synthesized voice.

Vibrato DB stores information of a change in gain (EGain) and pitch and other information obtained through analysis of a vibrato part of the original voice (real voice).

For example, if there is a vibrato part to be given to a voice to be synthesized, EpR parameters of the vibrato part are added with a change in gain (EGain) and pitch stored in Vibrato DB so that a natural change in gain and pitch can be added to the synthesized voice. Namely, natural vibrato can be reproduced.

Although this embodiment prepares five databases, synthesis of voices of a song can be performed basically by using at least Timbre DB, Stationary DB and Articulation DB if the information of voices of a song and pitches, voice volumes and mouth opening degrees is given.

Voices of a song rich in expression can be synthesized by using additional two databases Note DB and Vibrato DB. Databases to be added are not limited only to Note DB and Vibrato DB, but any database for voice expression may be used.

The database 7 outputs the EpR parameters of Excitation Curve EC, Chest Resonance CR, Vocal Tract Resonance VTR, and Spectral Shape Differential SSD calculated by using the above-described databases, as well as the inharmonic components UC.

As the inharmonic components UC, the database 7 outputs the magnitude spectrum and phase spectrum such as shown in FIG. 3. The inharmonic components US represent noise components of a voiced sound of the original voice unable to be expressed as harmonic components, and an unvoiced sound inherently unable to be expressed as harmonic components.

As shown in FIG. 16, Vocal Tract Resonance VTR and inharmonic components are output divisionally for the phase and magnitude.

The adder unit 8*a* adds Excitation Curve EC to the flat magnitude spectrum output from the windowing & FFT unit 6. Namely, the magnitude at each frequency calculated by the equation (a) by using EGain, ESlope and ESlope Depth is added. The addition result is sent to the adder unit 8*b* at the succeeding stage.

The obtained magnitude spectrum is a magnitude spectrum envelope (Excitation Curve) of a vocal tract vibration waveform such as shown in FIG. 4.

By changing EGain, ESlope and ESlope Depth in accordance with the functions shown in FIGS. 14A to 14C by using the Dynamics parameters, a change in tone color to be caused by a change in voice volume can be expressed.

If the voice volume is desired to be changed, EGain is changed as shown in FIGS. 11A and 11B. If the tone color is desired to be changed, ESlope is changed as shown in FIGS. 12A and 12B.

The adder unit 8*b* adds Chest Resonance CR obtained by the equation (d) to the magnitude spectrum added with Excitation Curve EC at the adder unit 8*a*, to thereby obtain the magnitude spectra added with the mountain of the magnitude spectrum of chest resonance such as shown in FIG. 7. The obtained magnitude spectrum is sent to the adder unit 8*c* at the succeeding stage.

By making the magnitude of Chest Resonance CR large, it is possible to change the chest resonance sound larger than the original voice quality. By lowering the frequency of Chest Resonance CR, it is possible to change the voice to the voice having a lower chest resonance sound.

The adder unit 8*c* adds Vocal Tract Resonance VTR obtained by the equation (c1) to the magnitude spectrum added with Chest Resonance CR at the adder unit 8*b*, to thereby obtain the magnitude spectra added with the mountain of the magnitude spectrum of vocal tract such as shown in FIG. 6. The obtained magnitude spectrum is sent to the adder unit 8*e* at the succeeding stage.

By adding Vocal Tract Resonance VTR, it is basically possible to express a difference between color tones to be caused by a difference between phonemes such as "a" and "i".

By changing the amplitude of each resonance in accordance with the Opening parameter described with FIG. 15 by using the frequency function, a change in tone color by a mouth opening degree can be reproduced.

By changing the frequency, magnitude, and bandwidth of each resonance, the sound quality can be changed to the sound quality different from the original sound quality (for example, to the sound quality of opera). By changing the pitch, male voices can be changed to female voices or vice versa.

The adder unit 8*d* adds Vocal Tract Resonance VTR obtained by the equation (c2) to the flat phase spectrum output from the windowing & FFT unit 6. The obtained phase spectrum is sent to the adder unit 8*g*.

The adder unit 8*e* adds Spectral Shape Differential Mag dB (fHz) to the magnitude spectrum added with Vocal Tract Resonance VTR at the adder unit 8*c* to obtain a more precise magnitude spectrum.

The adder unit 8*f* adds together the magnitude spectrum of the inharmonic components UC supplied from the database 7 and the magnitude spectrum sent from the adder unit 8*e*. The added magnitude spectrum is sent to the IFFT & overlap adder unit 9 at the succeeding stage.

The adder unit 8*g* adds together the phase spectrum of the inharmonic components supplied from the database 7 and the phase spectrum supplied from the adder unit 8*d*. The added phase spectrum is sent to the IFFT & overlap adder unit 9.

The IFFT & overlap adder unit 9 performs inverse fast Fourier transform (IFFT) of the supplied magnitude spectrum and phase spectrum, and overlap-adds together the transformed time waveforms to generate final synthesized voices.

According to the embodiment, a voice is analyzed into harmonic components and inharmonic components. The analyzed harmonic components can be analyzed into the magnitude spectrum envelope and a plurality of resonances respectively of a vocal cord waveform, and a difference between these envelopes and resonances and the original voice, which are stored.

According to the embodiment, the magnitude spectrum envelope of a vocal cord waveform can be represented by three EpR parameters EGain, ESlope and ESlope Depth.

According to the embodiment, by changing the EpR parameter corresponding to a change in voice volume in accordance with a prepared function, voice given a natural tone color change caused by a change in voice volume can be synthesized.

According to the embodiment, by changing the EpR parameter corresponding to a change in mouth opening degree in accordance with a prepared function, voice given a natural tone color change caused by a change in mouth opening degree can be synthesized.

Since the functions can be changed with each phoneme and each voice producer, voice can be synthesized by taking into consideration an individual characteristic difference between tone color changes caused by phonemes and voice producers.

Although the embodiment has been described mainly with reference to synthesis of voices of a song sung by a singer, the embodiment is not limited only thereto, but general speech sounds and musical instrument sounds can also be synthesized in a similar manner.

The embodiment may be realized by a computer or the like installed with a computer program and the like realizing the embodiment functions.

In this case, the computer program and the like realizing the embodiment functions may be stored in a computer readable storage medium such as a CD-ROM and a floppy disc to distribute it to a user.

If the computer and the like are connected to the communication network such as a LAN, the Internet and a telephone line, the computer program, data and the like may be supplied via the communication network.

The present invention has been described in connection with the preferred embodiments. The invention is not limited only to the above embodiments. It is apparent that various modifications, improvements, combinations, and the like can be made by those skilled in the art.

What are claimed are:

1. A voice analyzing apparatus comprising:

a first analyzer that analyzes a voice into harmonic components and inharmonic components:

a second analyzer that analyzes a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and a memory that stores the inharmonic components, the magnitude spectrum envelope of the vocal cord vibration waveform, resonances and the spectrum envelope of the difference.

2. A voice analyzing apparatus according to claim 1, wherein:

the magnitude spectrum envelope of the vocal cord vibration waveform is represented by three parameters EGain, ESlope and ESlope Depth; and the three parameters can be expressed by a following equation (1):

$$\text{ExcitationCurveMag}(f)=E\text{Gain}+E\text{SlopeDepth}\cdot(e^{-E\text{Slope}\cdot f}-1) \quad (1)$$

where Excitation Curve Mag (f) is the magnitude spectrum envelope of the vocal cord vibration waveform.

3. A voice analyzing apparatus according to claim 1, wherein the resonances include a plurality of resonances expressing vocal tract formants and a resonance expressing chest resonance.

4. A voice synthesizing apparatus comprising:

a memory that stores a magnitude spectrum envelope of a vocal cord vibration waveform, resonances and a spectrum envelope of a difference of a magnitude spectrum envelope of a harmonic components from a sum of the magnitude spectrum envelope of the vocal cord vibration waveform and the resonances, respectively analyzed from the harmonic components analyzed from a voice and inharmonic components analyzed from the voice;

an input device that inputs information of a voice to be synthesized;

a generator that generates a flat magnitude spectrum envelope; and an adding device that adds the inharmonic components, the magnitude spectrum envelope of the vocal cord vibration waveform, resonances and the spectrum envelope of the difference, respectively read from said memory, to the flat magnitude spectrum envelope, in accordance with the input information.

5. A voice synthesizing apparatus according to claim 4, wherein:

the magnitude spectrum envelope of the vocal cord vibration waveform is represented by three parameters EGain, ESlope and ESlope Depth; and the three parameters can be expressed by a following equation (1):

$$\text{ExcitationCurveMag}(f)=E\text{Gain}+E\text{SlopeDepth}\cdot(e^{-E\text{slope}\cdot f}-1) \quad (1)$$

where Excitation Curve Mag (f) is the magnitude spectrum envelope of the vocal cord vibration waveform.

6. A voice synthesizing apparatus according to claim 5, wherein said memory further stores a function for changing the three parameters in accordance with a change in sound volume so that tone color can be changed in accordance with the change in sound volume.

7. A voice synthesizing apparatus according to claim 4, wherein the resonances include a plurality of resonances expressing vocal tract formants and a resonance expressing chest resonance.

8. A voice synthesizing apparatus according to claim 7, wherein said memory further stores a function for changing an amplitude of each resonance in accordance with a mouth opening degree so that tone color can be changed in accordance with the mouth opening degree.

9. A voice synthesizing apparatus comprising:

a first analyzer that analyzes a voice into harmonic components and inharmonic components:

a second analyzer that analyzes a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances;

a memory that stores the inharmonic components, the magnitude spectrum envelope of the vocal cord vibration waveform, resonances and the spectrum envelope of the difference;

an input device that inputs information of a voice to be synthesized;

a generator that generates a flat magnitude spectrum envelope; and an adding device that adds the inharmonic components, the magnitude spectrum envelope of the vocal cord vibration waveform, resonances and the spectrum envelope of the difference, respectively read from said memory, to the flat magnitude spectrum envelope, in accordance with the input information.

10. A voice analyzing method comprising, the steps of:

(a) analyzing a voice into harmonic components and inharmonic components:

(b) analyzing a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and (c) storing the inharmonic components, the magnitude spectrum envelope of the vocal cord vibration waveform, resonances and the spectrum envelope of the difference.

11. A voice synthesizing method comprising, the steps of:

(a) reading a magnitude spectrum envelope of a vocal cord vibration waveform, resonances and a spectrum envelope of a difference of a magnitude spectrum envelope of a harmonic components from a sum of the magnitude spectrum envelope of the vocal cord vibration waveform and the resonances, respectively analyzed from the harmonic components analyzed from a voice and inharmonic components analyzed from the voice;

(b) inputting information of a voice to be synthesized;

(c) generating a flat magnitude spectrum envelope; and (d) adding the inharmonic components, the magnitude spectrum envelope of the vocal cord vibration waveform, resonances and the spectrum envelope of the difference, respectively read at said step (a), to the flat magnitude spectrum envelope, in accordance with the input information.

12. A program that a computer executes to realize a music data performance process, comprising the instructions of:

(a) analyzing a voice into harmonic components and inharmonic components:

(b) analyzing a magnitude spectrum envelope of the harmonic components into a magnitude spectrum envelope of a vocal cord vibration waveform, resonances and a spectrum envelope of a difference of the magnitude spectrum envelope of the harmonic components from a sum of the magnitude spectrum envelope of the vocal cord vibration waveform and the resonances; and (c) storing the inharmonic components, the magnitude spectrum envelope of the vocal cord vibration waveform, resonances and the spectrum envelope of the difference.

13. A program that a computer executes to realize a music data performance process, comprising the instructions of:

(a) reading a magnitude spectrum envelope of a vocal cord vibration waveform, resonances and a spectrum envelope of a difference of a magnitude spectrum envelope of a harmonic components from a sum of the magnitude spectrum envelope of the vocal cord vibration waveform and the resonances, respectively analyzed from the harmonic components analyzed from a voice and inharmonic components analyzed from the voice;

(b) inputting information of a voice to be synthesized;

(c) generating a flat magnitude spectrum envelope; and (d) adding the inharmonic components, the magnitude spectrum envelope of the vocal cord vibration waveform, resonances and the spectrum envelope of the difference, respectively read at said step (a), to the flat magnitude spectrum envelope, in accordance with the input information.

* * * * *